US007118190B2

(12) United States Patent
Sakamoto et al.

(10) Patent No.: US 7,118,190 B2
(45) Date of Patent: Oct. 10, 2006

(54) INKJET PRINTING APPARATUS AND CLEANING CONTROL METHOD THEREFOR

(75) Inventors: Atsushi Sakamoto, Kanagawa (JP); Hidehiko Kanda, Kanagawa (JP); Aya Sugimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 10/781,737

(22) Filed: Feb. 20, 2004

(65) Prior Publication Data

US 2004/0165030 A1 Aug. 26, 2004

(30) Foreign Application Priority Data

Feb. 26, 2003 (JP) ..... 2003-049973
Feb. 3, 2004 (JP) ..... 2004-027121

(51) Int. Cl.
*B41J 2/165* (2006.01)

(52) U.S. Cl. ..... 347/23; 347/29; 347/30; 347/32; 347/33; 347/35

(58) Field of Classification Search ..... 347/19, 347/22–35

See application file for complete search history.

(56) References Cited

U.S. PATENT DOCUMENTS

| | | | | |
|---|---|---|---|---|
| 5,805,182 | A | 9/1998 | Lee | |
| 6,193,351 | B1 | 2/2001 | Yaegashi et al. | 347/23 |
| 6,231,156 | B1 * | 5/2001 | Ono | 347/24 |
| 6,283,574 | B1 | 9/2001 | Sugimoto et al. | 347/23 |
| 6,382,764 | B1 * | 5/2002 | Shimoda | 347/23 |
| 6,382,765 | B1 | 5/2002 | Kanda et al. | 347/23 |
| 6,746,096 | B1 | 6/2004 | Sakamoto et al. | 347/23 |

FOREIGN PATENT DOCUMENTS

| | | |
|---|---|---|
| JP | 2000-94701 | 4/2000 |
| JP | 2003-165231 | 6/2003 |

* cited by examiner

*Primary Examiner*—Shih-Wen Hsieh
(74) *Attorney, Agent, or Firm*—Fitzpatrick, Cella, Harper & Scinto

(57) ABSTRACT

In cleaning an orifice surface in which the orifices of a printhead are formed, a portion of the orifice surface that readily becomes dirty along with ink discharge from the printhead is preferentially cleaned.

18 Claims, 9 Drawing Sheets

| | CLEANING EXECUTION VALUE |
|---|---|
| YELLOW, CYAN (CENTER) | 15840000 DOTS |
| MAGENTA, BLACK (OUTERMOST) | 31680000 DOTS |

FIG. 4

| | CLEANING EXECUTION VALUE |
|---|---|
| YELLOW (CENTER) | 15840000 DOTS |
| MAGENTA, CYAN (OUTERMOST) | 31680000 DOTS |

FIG. 5

| WIPING EXECUTION THRESHOLD | PRINTED IMAGE | ERROR | | |
|---|---|---|---|---|
| | | PRINTING DISTORTION | PRINTING OMISSION (NON-DISCHARGE) | WIPING COUNT |
| Cyan<br>Magenta<br>Yellow<br>UNIFORMLY 31680000 DOTS | Cyan SOLID IMAGE | 0 IMAGE/10 IMAGES | 0 IMAGE/10 IMAGES | 10 TIMES |
| | Magenta SOLID IMAGE | 0 IMAGE/10 IMAGES | 0 IMAGE/10 IMAGES | 10 TIMES |
| | Yellow SOLID IMAGE | 0 IMAGE/10 IMAGES | 0 IMAGE/10 IMAGES | 10 TIMES |
| | Red SOLID IMAGE | 8 IMAGES/10 IMAGES | 5 IMAGES/10 IMAGES | 10 TIMES |
| | Green SOLID IMAGE | 8 IMAGES/10 IMAGES | 6 IMAGES/10 IMAGES | 10 TIMES |
| | Blue SOLID IMAGE | 0 IMAGE/10 IMAGES | 0 IMAGE/10 IMAGES | 10 TIMES |
| | TOTAL | 16 IMAGES/60 IMAGES | 11 IMAGES/60 IMAGES | 60 TIMES |
| Cyan<br>Magenta<br>Yellow<br>UNIFORMLY 15840000 DOTS | Cyan SOLID IMAGE | 0 IMAGE/10 IMAGES | 0 IMAGE/10 IMAGES | 20 TIMES |
| | Magenta SOLID IMAGE | 0 IMAGE/10 IMAGES | 0 IMAGE/10 IMAGES | 20 TIMES |
| | Yellow SOLID IMAGE | 0 IMAGE/10 IMAGES | 0 IMAGE/10 IMAGES | 20 TIMES |
| | Red SOLID IMAGE | 0 IMAGE/10 IMAGES | 0 IMAGE/10 IMAGES | 20 TIMES |
| | Green SOLID IMAGE | 0 IMAGE/10 IMAGES | 0 IMAGE/10 IMAGES | 20 TIMES |
| | Blue SOLID IMAGE | 0 IMAGE/10 IMAGES | 0 IMAGE/10 IMAGES | 20 TIMES |
| | TOTAL | 0 IMAGES/60 IMAGES | 0 IMAGES/60 IMAGES | 120 TIMES |
| Cyan : 31680000 DOTS<br>Magenta : 31680000 DOTS<br>Yellow : 15840000 DOTS | Cyan SOLID IMAGE | 0 IMAGE/10 IMAGES | 0 IMAGE/10 IMAGES | 10 TIMES |
| | Magenta SOLID IMAGE | 0 IMAGE/10 IMAGES | 0 IMAGE/10 IMAGES | 10 TIMES |
| | Yellow SOLID IMAGE | 0 IMAGE/10 IMAGES | 0 IMAGE/10 IMAGES | 20 TIMES |
| | Red SOLID IMAGE | 0 IMAGE/10 IMAGES | 0 IMAGE/10 IMAGES | 20 TIMES |
| | Green SOLID IMAGE | 0 IMAGE/10 IMAGES | 0 IMAGE/10 IMAGES | 20 TIMES |
| | Blue SOLID IMAGE | 0 IMAGE/10 IMAGES | 0 IMAGE/10 IMAGES | 10 TIMES |
| | TOTAL | 0 IMAGES/60 IMAGES | 0 IMAGES/60 IMAGES | 90 TIMES |

FIG. 7

| | CLEANING EXECUTION VALUE |
|---|---|
| YELLOW, CYAN (CENTER) | 15840000 DOTS |
| MAGENTA, BLACK (OUTERMOST) | 31680000 DOTS |

FIG. 8

| | ARITHMETIC PROCESSING FOR DISCHARGED DOT COUNT |
|---|---|
| YELLOW (CENTER) | Din × 2 |
| MAGENTA, CYAN (OUTERMOST) | Dout × 1 |

WIPING EXECUTION VALUE : 31680000 DOTS

FIG. 9

| WEIGHTING PROCESSING FOR DISCHARGED DOT COUNT OF EACH ORIFICE GROUP (WIPING EXECUTION THRESHOLD:UNIFORMLY 31680000 DOTS) | PRINTED IMAGE | ERROR | | |
|---|---|---|---|---|
| | | PRINTING DISTORTION | PRINTING OMISSION (NON-DISCHARGE) | WIPING COUNT |
| Cyan DISCHARGED DOT COUNT × 1 Magenta : DISCHARGED DOT COUNT × 1 Yellow DISCHARGED DOT COUNT × 1 | Cyan SOLID IMAGE | 0 IMAGE/10 IMAGES | 0 IMAGE/10 IMAGES | 10 TIMES |
| | Magenta SOLID IMAGE | 0 IMAGE/10 IMAGES | 0 IMAGE/10 IMAGES | 10 TIMES |
| | Yellow SOLID IMAGE | 0 IMAGE/10 IMAGES | 0 IMAGE/10 IMAGES | 10 TIMES |
| | Red SOLID IMAGE | 8 IMAGES/10 IMAGES | 5 IMAGES/10 IMAGES | 10 TIMES |
| | Green SOLID IMAGE | 8 IMAGES/10 IMAGES | 6 IMAGES/10 IMAGES | 10 TIMES |
| | Blue SOLID IMAGE | 0 IMAGE/10 IMAGES | 0 IMAGE/10 IMAGES | 10 TIMES |
| | TOTAL | 16 IMAGES/60 IMAGES | 11 IMAGES/60 IMAGES | 60 TIMES |
| Cyan : DISCHARGED DOT COUNT × 2 Magenta : DISCHARGED DOT COUNT × 2 Yellow : DISCHARGED DOT COUNT × 2 | Cyan SOLID IMAGE | 0 IMAGE/10 IMAGES | 0 IMAGE/10 IMAGES | 20 TIMES |
| | Magenta SOLID IMAGE | 0 IMAGE/10 IMAGES | 0 IMAGE/10 IMAGES | 20 TIMES |
| | Yellow SOLID IMAGE | 0 IMAGE/10 IMAGES | 0 IMAGE/10 IMAGES | 20 TIMES |
| | Red SOLID IMAGE | 0 IMAGE/10 IMAGES | 0 IMAGE/10 IMAGES | 20 TIMES |
| | Green SOLID IMAGE | 0 IMAGE/10 IMAGES | 0 IMAGE/10 IMAGES | 20 TIMES |
| | Blue SOLID IMAGE | 0 IMAGE/10 IMAGES | 0 IMAGE/10 IMAGES | 20 TIMES |
| | TOTAL | 0 IMAGES/60 IMAGES | 0 IMAGES/60 IMAGES | 120 TIMES |
| Cyan : DISCHARGED DOT COUNT × 1 Magenta : DISCHARGED DOT COUNT × 1 Yellow : DISCHARGED DOT COUNT × 2 | Cyan SOLID IMAGE | 0 IMAGE/10 IMAGES | 0 IMAGE/10 IMAGES | 10 TIMES |
| | Magenta SOLID IMAGE | 0 IMAGE/10 IMAGES | 0 IMAGE/10 IMAGES | 10 TIMES |
| | Yellow SOLID IMAGE | 0 IMAGE/10 IMAGES | 0 IMAGE/10 IMAGES | 20 TIMES |
| | Red SOLID IMAGE | 0 IMAGE/10 IMAGES | 0 IMAGE/10 IMAGES | 20 TIMES |
| | Green SOLID IMAGE | 0 IMAGE/10 IMAGES | 0 IMAGE/10 IMAGES | 20 TIMES |
| | Blue SOLID IMAGE | 0 IMAGE/10 IMAGES | 0 IMAGE/10 IMAGES | 10 TIMES |
| | TOTAL | 0 IMAGES/60 IMAGES | 0 IMAGES/60 IMAGES | 90 TIMES |

INKJET PRINTING APPARATUS AND CLEANING CONTROL METHOD THEREFOR

FIELD OF THE INVENTION

The present invention relates to an inkjet printing apparatus which discharges, e.g., ink to form an image on a printing medium, and a cleaning control method therefor.

BACKGROUND OF THE INVENTION

Conventionally, inkjet printing apparatuses have widely been used for a printer, copying machine, and the like because of low noise, low running cost, and easy downsizing of the apparatus. Of these inkjet printing apparatuses, an inkjet printing apparatus has recently been popular, which uses thermal energy as energy used to discharge ink and discharges ink by bubbles generated by thermal energy.

In the inkjet printing apparatus, when a foreign matter such as an unwanted ink droplet or paper dust attaches to an orifice surface (printhead end face which has orifices and faces a printing medium), the ink discharge direction deviates, the ink droplet landing position shifts, and the image quality decreases. That is, the inkjet printing apparatus prints by discharging ink droplets from the printhead to a printing medium (e.g., a paper sheet or OHP film). Small ink droplets may attach to the orifice surface of the printhead due to small ink droplets formed other than discharged main ink droplets or the splash of ink droplets landed on a printing medium, and the orifice surface may become wet. Small ink droplets formed by small ink droplets other than main ink droplets upon discharge or the splash of ink droplets are called an ink mist or simply a mist. When the orifice surface gets wet by ink and a large amount of ink is deposited around the orifice, ink discharge may be inhibited to discharge ink in an unexpected direction (distortion), or no ink droplet may be discharged (non-discharge).

To solve these problems caused by the use of liquid ink in the inkjet printing apparatus, a water repellent is formed on the face surface (orifice surface) in an inkjet printhead to repel ink droplets around the orifice, thereby preventing non-discharge and distortion. As a unique arrangement which is not adopted in other printing apparatuses, the inkjet printing apparatus employs an arrangement in which a wiping member in contact with the orifice surface is arranged and the wiping member and orifice surface are relatively moved to wipe a foreign matter such as ink droplets on the orifice surface. This arrangement refreshes (recovers) the orifice surface to prevent or recover distortion of the discharge direction or non-discharge. The wiping means often adopts an arrangement in which the orifice surface is wiped by a blade (wiper) formed from an elastic material such as rubber, thereby wiping unwanted ink droplets. As for the timing when the wiping means is performed, a deposit on the orifice surface is generally removed during printing or at the end of printing.

Japanese Patent Laid-Open No. 2000-094701 (U.S. Pat. No. 6,283,574) discloses an arrangement in which the wiping frequency during printing of one page of the next printing sheet is decreased by controlling to execute wiping operation under predetermined conditions after delivery of a printing sheet in order to reduce density unevenness upon a change in printing density caused by wiping operation within one page of the printing sheet.

However, the conventional inkjet printing apparatus suffers peeling of the water repellent formed on the head surface along with an increase in wiping count, or a short service life of the head due to the wear of the face surface.

Along with recent reductions in the size and cost of inkjet printing apparatuses, printing element substrates (semiconductor chips) on which orifice groups and orifice lines are formed are being downsized. Further, as printing apparatuses achieve high image quality, the drop size is decreased to eject smaller ink droplets, and orifices are arranged at higher density. With compact printing element substrates and high orifice arrangement density, problems which have been negligible in conventional inkjet printing apparatuses become significant. These problems will be described in detail.

Ink droplets discharged from a plurality of adjacent orifice groups or orifice lines are considered to be influenced by air flows formed by ink droplets flying from the adjacent orifice groups or orifice lines, compared to ink droplets discharged from a single orifice group or orifice line. More specifically, ink droplets which are discharged from orifices and land on a printing medium generate downward air flows along the loci of ink droplets and air flows which spread around ink droplet landing positions along the printing medium. When a plurality of orifice lines each having an array of orifices exist and ink droplets are discharged from the orifice lines, air flows which are formed along the printing medium by ink droplets from the orifice lines collide against each other, generating upward air flows from the ink droplet landing positions toward the orifice lines. As the interval between adjacent orifice groups or orifice lines decreases along with downsizing of the printing element substrate described above and the orifice density increases, the influence of air flows formed by ink droplets flying from adjacent orifices becomes stronger than in the conventional printing apparatus.

As a result, a mist generated by ink droplets other than main droplets upon discharge or splash upon landing flies up under the influence of air flows, and attaches to the face surface having the orifices of the printhead in accordance with the distance between the orifice groups or orifice lines of the printhead used in the printing apparatus, the discharge frequency, and the ink droplet discharge rate. As the interval between adjacent orifice groups or orifice lines decreases, image errors such as a shift of the ink droplet landing position in a printed image and non-discharge of failing to discharge any ink droplet readily occur in comparison with the conventional inkjet printing apparatus. Even if the interval between adjacent orifice groups or orifice lines decreases, the frequency of performing the orifice cleaning means such as cleaning or wiping for the printhead abruptly increases to obtain a stable image.

SUMMARY OF THE INVENTION

The present invention has been made to overcome the conventional drawbacks, and has as its object to provide a low-cost inkjet printing apparatus capable of outputting a stable printed image by executing cleaning at an optimal timing in accordance with the arrangement of the orifice lines of a printhead without generating any image error under the influence of ink droplets attached to the face surface of the printhead or the like and without shortening the service life of the printhead even in an inkjet printing apparatus which achieves a compact printing element substrate of the printhead mounted in the printing apparatus, small ink droplets, and high orifice density, and a cleaning control method for the inkjet printing apparatus.

To solve the above problems and achieve the above object, according to the present invention, there is provided an inkjet printing apparatus having a printhead with an orifice surface in which a plurality of orifice groups each formed-by a plurality of orifices for discharging ink are formed, and cleaning means for cleaning the orifice surface, comprising counting means for detecting and storing an ink discharge count of each orifice group, and cleaning control means for cleaning the orifice surface by the cleaning means in accordance with ink discharge counts of the plurality of orifice groups, wherein in the cleaning control means, an ink discharge count used to execute cleaning in accordance with a discharge count of ink discharged from an orifice group formed at a predetermined position of the printhead out of the plurality of orifice groups, and an ink discharge count used to execute cleaning in accordance with a discharge count of ink discharged from another orifice group formed at a position different from the orifice group formed at the predetermined position are different.

Preferably in the apparatus, the cleaning control means determines, on the basis of the discharge count of each orifice group that is stored in the counting means, whether a predetermined cleaning condition which changes in accordance with a formation position of the orifice group has been established, and when the predetermined cleaning condition has been established, executes cleaning.

Preferably in the apparatus, the cleaning control means determines as the predetermined cleaning condition whether the discharge count of each orifice group has reached a predetermined count, and in the predetermined cleaning condition, a predetermined count corresponding to an outer orifice group and a predetermined count corresponding to an orifice group arranged inside from the outer orifice group are different.

Preferably in the apparatus, the cleaning control means determines as the predetermined cleaning condition whether the discharge count of each orifice group has reached a predetermined count, and in the predetermined cleaning condition, a predetermined count corresponding to the orifice group formed at the predetermined position and a predetermined count corresponding to another orifice group formed outside the orifice group formed at the predetermined position are different.

Preferably in the apparatus, the cleaning control means determines as the cleaning condition whether a value obtained by multiplying the discharge count of each orifice group by a weighting coefficient has reached a predetermined count, and a weighting coefficient corresponding to an outer orifice group and a weighting coefficient corresponding to an orifice group arranged inside from the outer orifice group are different.

Preferably in the apparatus, the cleaning control means determines as the cleaning condition whether a value obtained by multiplying the discharge count of each orifice group by a weighting coefficient has reached a predetermined count, and a weighting coefficient corresponding to the predetermined orifice group and a weighting coefficient corresponding to another orifice group formed outside the predetermined orifice group are different.

Preferably in the apparatus, the predetermined count corresponding to the outer orifice group is larger than the predetermined count corresponding to the orifice group arranged inside from the outer orifice group.

Preferably in the apparatus, the weighting coefficient corresponding to the outer orifice group is smaller than the weighting coefficient corresponding to the orifice group arranged inside from the outer orifice group.

Preferably, the apparatus further comprises detection means for detecting a distance between the orifice groups formed in the printhead, and setting means for setting the cleaning condition in accordance with the distance between the orifice groups that is detected by the detection means.

Preferably in the apparatus, when the cleaning control means determines that the predetermined cleaning condition for any one of the orifice groups of respective inks has been established, the cleaning control means cleans the orifice surface.

In the apparatus, the cleaning control means defines, as a discharge count of ink discharged from the printhead, a value obtained by multiplying the discharge count of each orifice group by a weighting coefficient corresponding to a formation position of the orifice group, determines whether the cleaning condition of the printhead has been established, on the basis of the discharge count of ink discharged from the printhead, and when the cleaning condition of the printhead has been established, executes cleaning.

Preferably in the apparatus, a weighting coefficient corresponding to the orifice group formed at the predetermined position and a weighting coefficient corresponding to another orifice group formed outside the orifice group formed at the predetermined position are different.

Preferably, the apparatus further comprises detection means for detecting a distance between the orifice groups formed in the printhead, and the weighting coefficient is changed in accordance with the distance between the orifice groups that is detected by the detection means.

Preferably in the apparatus, the cleaning means includes wiping means for wiping an end face of the orifice by an elastic member.

Preferably in the apparatus, the orifice groups are arranged for at least yellow, magenta, and cyan colors.

According to the present invention, there is provided a cleaning control method for an inkjet printing apparatus having a printhead with an orifice surface in which a plurality of orifice groups each formed by a plurality of orifices for discharging ink are formed, and cleaning means for cleaning the orifice surface, comprising a counting step of detecting and storing an ink discharge count of each orifice group, and a cleaning control step of cleaning the orifice surface by the cleaning means in accordance with ink discharge counts of the plurality of orifice groups, wherein in the cleaning control step, an ink discharge count used to execute cleaning in accordance with a discharge count of ink discharged from an orifice group formed at a predetermined position of the printhead out of the plurality of orifice groups, and an ink discharge count used to execute cleaning in accordance with a discharge count of ink discharged from another orifice group formed at a position different from the orifice group formed at the predetermined position are different.

Preferably in the method, in the cleaning control step, a value obtained by multiplying the discharge count of each orifice group that is detected in the counting step by a weighting coefficient corresponding to a formation position of the orifice group is defined as a discharge count of ink discharged from the printhead, whether a cleaning condition of the printhead has been established is determined on the basis of the discharge count of ink discharged from the printhead, and when the cleaning condition of the printhead has been established, cleaning is executed.

Preferably in the method, in the cleaning control step, when the discharge count of each orifice group that is stored in the counting step reaches a predetermined value, the cleaning condition is determined to have been established and the orifice surface is cleaned, and a predetermined count corresponding to an outer orifice group and a predetermined count corresponding to an orifice group arranged inside from the outer orifice group are different.

Preferably in the method, in the cleaning control step, when a value obtained by multiplying the discharge count of each orifice group that is stored in the counting step by a weighting coefficient reaches a predetermined value, the cleaning condition is determined to have been established and the orifice surface is cleaned, and a weighting coefficient corresponding to an outer orifice group and a weighting coefficient corresponding to an orifice group arranged inside from the outer orifice group are different.

According to the present invention, there is provided an inkjet printing apparatus having a printhead with an orifice surface in which a plurality of orifice groups each formed by a plurality of orifices for discharging ink are formed, and cleaning means for cleaning the orifice surface, comprising storage means for storing, for each of the plurality of orifice groups, information on a discharge amount of ink discharged from the orifice group, and cleaning control means for cleaning the orifice surface by the cleaning means when an ink discharge amount represented by the information stored in the storage means exceeds a predetermined amount, wherein an ink discharge amount used to shift to cleaning operation is different between an orifice group formed at a predetermined position of the printhead and an orifice group formed at a position different from the orifice group formed at the predetermined position.

The above arrangement can realize control so as not to generate any image error under the influence of ink droplets or the like attaching to the face surface of the printhead and shorten the service life of the printhead. The user can be provided with a high-image-quality, low-cost, high-reliability inkjet printing apparatus and a cleaning control method therefor.

The orifice group in the present invention includes one orifice line or two or more orifice lines for each ink.

As described above, the present invention can constitute high-reliability cleaning means capable of providing a stable printed image regardless of the arrangement of the orifices of an inkjet printhead, and reduce the costs of the building components of the inkjet printer main body and printhead. The user can be provided with a low-cost, high-reliability inkjet printing apparatus.

Other objects and advantages besides those discussed above shall be apparent to those skilled in the art from the description of a preferred embodiment of the invention, which follows. In the description, reference is made to the accompanying drawings, which form a part thereof, and which illustrate an example of the invention. Such example, however, is not exhaustive of the various embodiments of the invention, and therefore reference is made to the claims, which follow the description for determining the scope of the invention.

BRIEF DESCRIPTION OF THE DRAWINGS

FIG. 4 is a table showing the cleaning execution threshold of each orifice group;

FIG. 5 is a table showing comparison between the effect of uniformly setting the same wiping execution threshold for the orifice groups of the respective colors and the effect of setting the wiping execution thresholds in FIG. 4 when the printhead in FIG. 3B is used;

FIG. 7 is a table showing the cleaning execution threshold of each orifice group;

FIG. 8 is a table showing the value of counter value integrating processing for the discharged dot count of each orifice group when three orifice groups are arranged in an order of magenta, yellow, and cyan; and FIG. 9 is a table showing comparison between the effect of uniformly setting the same weighting coefficient for the discharged dot counts of the orifice groups of the respective colors and the effect of setting the weighting coefficient for the discharged dot count of a central orifice group in FIG. 8 and the weighting coefficient for the discharged dot counts of two outermost orifice groups to different values when the printhead having the arrangement in FIG. 3B is used.

DETAILED DESCRIPTION OF THE PREFERRED EMBODIMENTS

Preferred embodiments of the present invention will be described in detail below with reference to the accompanying drawings.

First Embodiment

Figure 1:
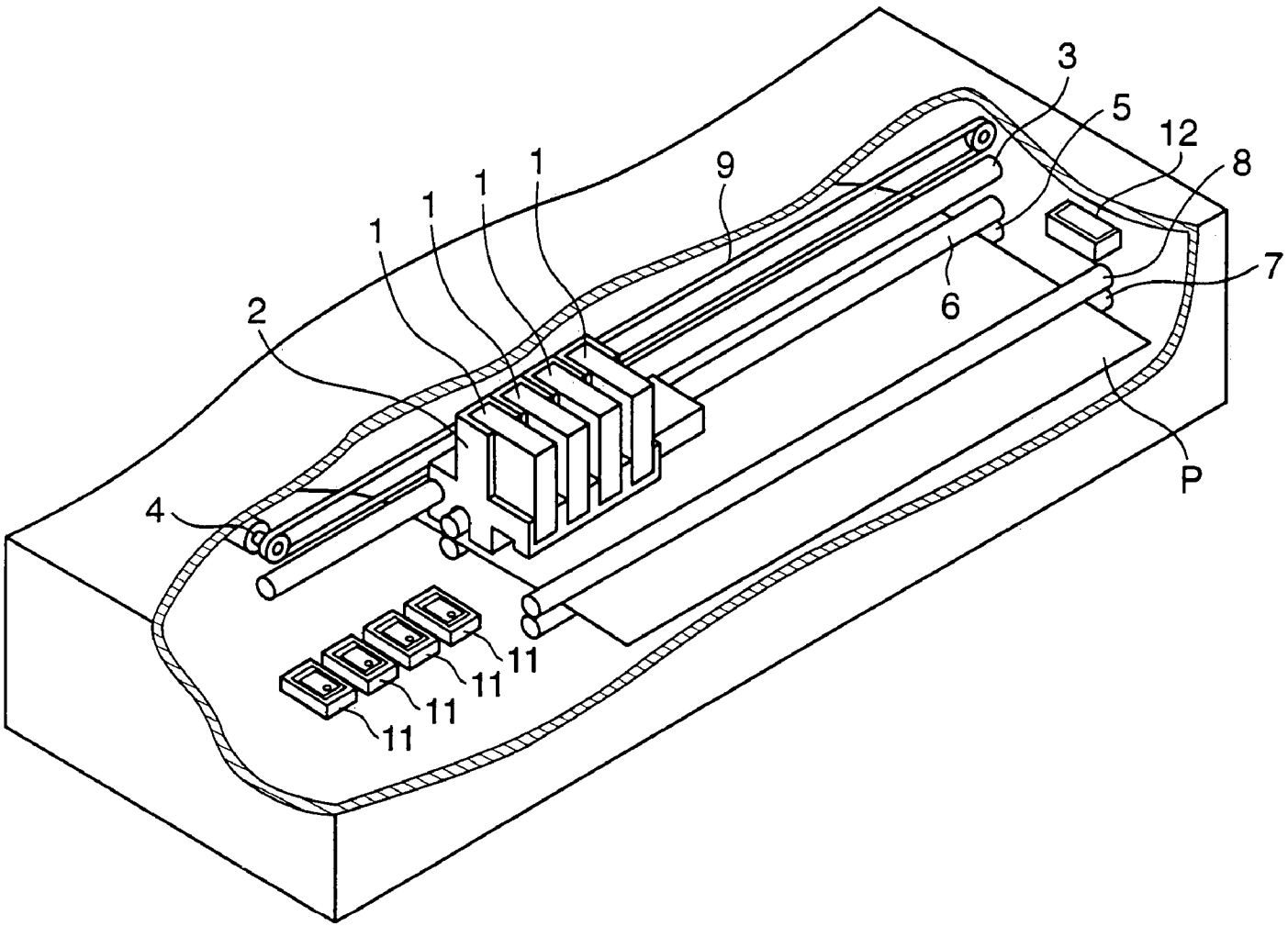
FIG. 1 is a schematic perspective view showing an inkjet printing apparatus to which the present invention can be applied.

FIG. 1 is a perspective view showing the schematic arrangement of a printing apparatus having a printhead which prints in accordance with the inkjet method according to a typical embodiment of the present invention.

In FIG. 1, reference numeral 1 denotes ink cartridges (to be referred to as cartridges hereinafter) each having an ink tank as an upper part, a printhead as a lower part, and a connector for receiving signals for driving the printhead; and 2, a carriage which supports these cartridges 1. The ink tanks of the cartridges 1 store inks of different colors such as yellow, magenta, cyan, and black. The carriage 2 has a connector holder for transmitting signals for driving the printhead of each cartridge 1, and is electrically connected to the printhead. In the example shown in FIG. 1, the carriage 2 supports the four cartridges 1 which store magenta, yellow, cyan, and black inks in the ink tanks from the left ink tank.

Reference numeral 3 denotes a scanning rail which extends in a direction (main scanning direction) in which the printhead reciprocates and slidably supports the carriage 2; 4, a carriage motor; 9, a driving belt which transmits the driving force of the carriage motor 4 in order to reciprocate the carriage 2 in the main scanning direction; and 5 and 6, and 7 and 8, pairs of convey rollers which are arranged before and after the printing position on a printing medium by the printhead, and clamp and convey the printing medium. Reference symbol P denotes a printing medium such as a paper sheet. The printing medium P is pressed against the guide surface of a platen (not shown) which regulates the printing surface to a flat state.

The printhead of the cartridge 1 mounted on the carriage 2 extends below from the carriage 2, and is located between the convey rollers 6 and 8. The end face having the orifice of the printhead faces parallel to the printing medium P pressed against the guide surface of the platen (not shown).

In the printing apparatus of the first embodiment, a main recovery system unit is arranged on the home position side at a lower portion in FIG. 1.

In the recovery system unit, reference numeral 11 denotes cap units which are arranged in correspondence with the respective printheads of the four cartridges 1 and can vertically elevate. When the carriage 2 stays at the home position, the cap units 11 contact the printheads to cap them. This prevents evaporation of ink in the orifices of the printheads, and a discharge error caused by an increase in ink viscosity or evaporation and fixation of a volatile component.

The interior of the cap unit 11 communicates with a pump unit (not shown). The pump unit generates a negative pressure, as needed. The timing when a negative pressure is generated is, e.g., the timing when the printhead fails to discharge ink, the timing of suction recovery when the cap unit 11 and printhead are made to contact each other to suck ink from the printhead, or the timing when ink discharged to the cap of the cap unit 11 is removed (also referred to as air suction).

Reference numeral 12 denotes a preliminary discharge reception portion which is arranged on a side opposite to the home position via a printing operation region for the printing medium P. A preliminary discharge operation is performed. In this operation, ink droplets which do not contribute to printing are discharged from the orifice of the printhead to the preliminary discharge reception portion 12. The preliminary discharge reception portion 12 is arranged on an upper side in FIG. 1, and forms part of the recovery system unit. The recovery system unit may be equipped with a blade formed from an elastic material such as rubber, and wipes droplets attaching to an end face (to be also referred to as an orifice surface or face surface hereinafter) having the orifice of the printhead. To solve the push of unwanted matter to the orifice by wiping, preliminary discharge is executed after wiping to stabilize the discharge state.

In the printing apparatus according to the first embodiment, one common motor is used as a convey driving motor for conveying the printing medium P and a driving motor for operating the recovery system unit.

As another recovery system unit (not shown), the printing apparatus comprises a counter and memory for executing a means or step of detecting and storing the ink discharge count per unit time for each orifice group, and an arithmetic processing circuit for executing a determination means or step of determining on the basis of the discharge count of each orifice group whether a cleaning condition (to be described later) has been established, and a cleaning control means or step of cleaning the end face of the orifice by a cleaning means when the cleaning condition has been established.

The characteristic features of the recovery system unit according to the first embodiment of the present invention will be explained.

In the first embodiment, the cleaning condition is set to a different condition in accordance with the position of the orifice group of each ink.

As the cleaning condition of the first embodiment, a cleaning execution threshold used to determine whether the cumulative discharge count of each orifice group has reached a predetermined cleaning execution threshold is set to different values for outermost orifice groups and orifice groups arranged between the outermost orifice groups.

The cleaning execution threshold of orifice groups arranged between outermost orifice groups is set to a value smaller than that of the outermost orifice groups.

As the cleaning condition of the second embodiment, whether a value obtained by multiplying the discharge count of each orifice group by a weighting coefficient has reached a predetermined cleaning execution threshold is determined. The weighting coefficient is set to different values for outermost orifice groups and orifice groups arranged between the outermost orifice groups.

The weighting coefficients of orifice groups arranged between outermost orifice groups are set to values larger than those of the outermost orifice groups.

Figure 2:
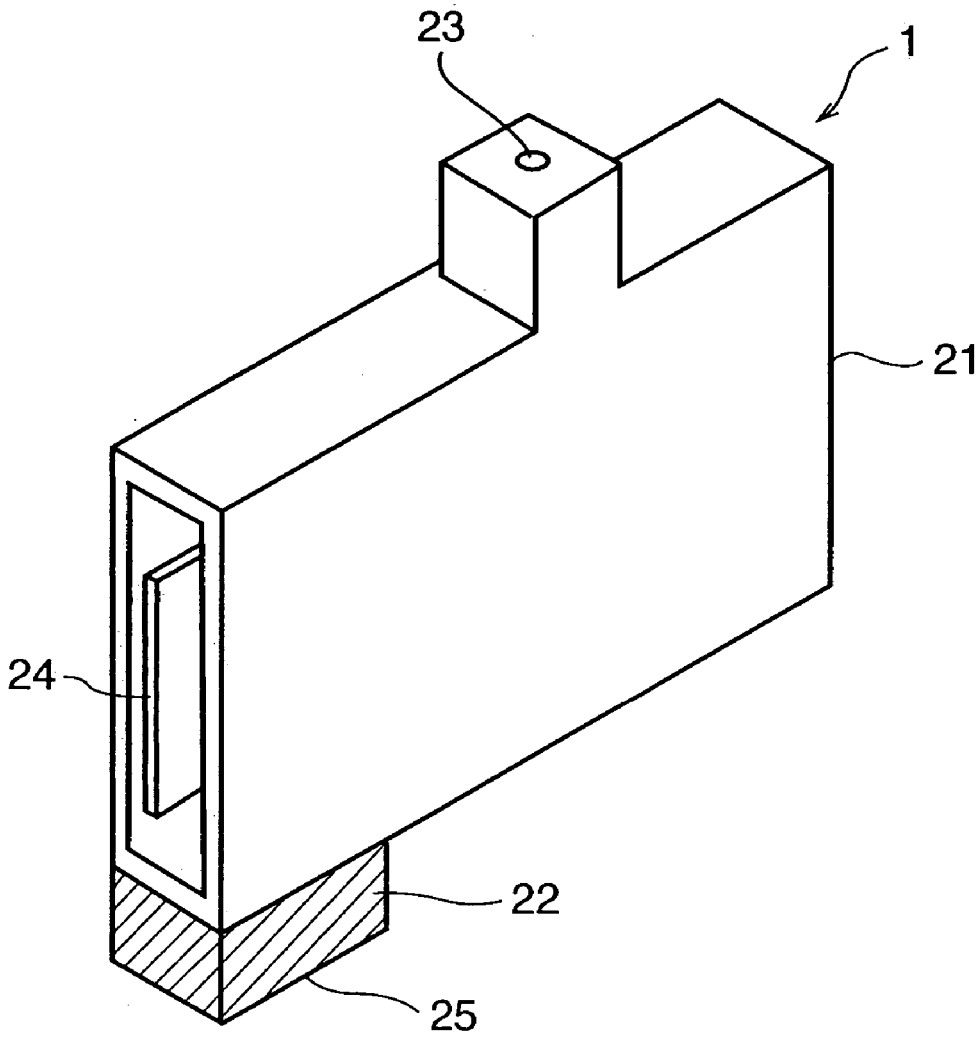
FIG. 2 is a perspective view showing an inkjet cartridge used in the inkjet printing apparatus in FIG. 1.

FIG. 2 is a perspective view showing the inkjet cartridge as the integration of the printhead and ink tank.

As shown in FIG. 2, the cartridge 1 comprises an ink tank 21 as an upper part and a printhead 22 as a lower part. An air hole 23 is formed at the top of the ink tank 21, and a head connector 24 is attached to a position aligned with the ink tank 21. The connector 24 receives signals for driving the printhead 22, and outputs a remaining ink amount detection signal. The printhead 22 has an orifice surface 25 with a plurality of orifices which are opened in the bottom surface at a lower portion in FIG. 2. A liquid channel which communicates with each orifice is equipped with an electrothermal transducer which generates thermal energy necessary to discharge ink.

Figure 3B:
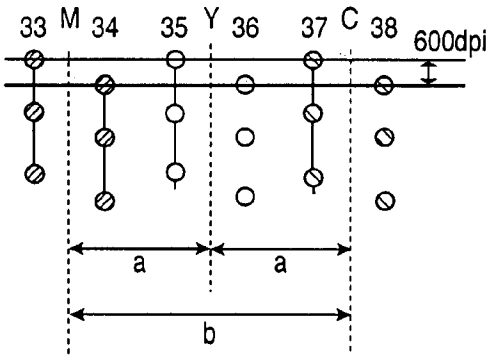
FIG. 3B is an enlarged view of a portion X surrounded by a dotted line in FIG. 3A schematically showing a state in which three orifice groups each formed by two orifice lines for each ink color are arranged.
Figure 3C:
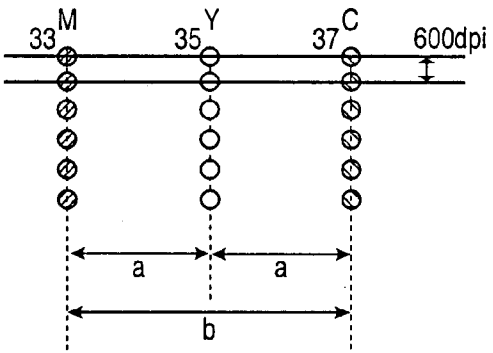
FIG. 3C is a schematic view showing a state in which one orifice line is formed for each ink color and three orifice lines are arranged.
Figure 3A:
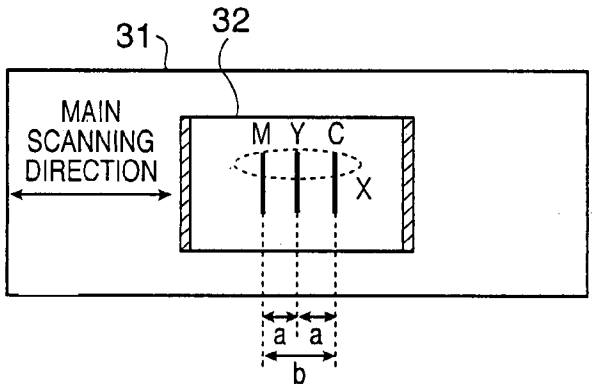
FIG. 3A is a schematic view showing a printhead having three orifice groups for discharging inks of three colors (C, M, and Y) when viewed from the discharge direction.

FIG. 3A is a schematic view showing a printhead having three orifice groups for discharging inks of three colors (C, M, and Y) when viewed from the discharge direction.

Reference numeral 31 denotes a TAB portion where wiring lines are formed; and 32, a chip portion where orifices are formed. Orifice groups are formed at equal intervals corresponding to a width a in an order of magenta (M), yellow (Y), and cyan (C) from the left. FIG. 3B is an enlarged view showing a portion X surrounded by a dotted line in FIG. 3A. Reference numerals 33 and 34 denote magenta (M) orifice lines. These two orifice lines form a magenta (M) orifice group. Similarly, reference numerals 35 and 36 denote yellow (Y) orifice lines; and 37 and 38, cyan (C) orifice lines. The two orifice lines form an orifice group of each color.

The intervals between the magenta (M) and yellow (Y) orifice groups and the yellow (Y) and cyan (C) orifice groups are a, and the interval between the magenta (M) and cyan (C) orifice groups is b. In the printhead, for example, the width a is 1.5 mm, and the width b is 3.0 mm.

The interval between orifices in the orifice line direction is 600 dpi, and orifices are alternately arranged in the two orifice lines. The discharge amount of an ink droplet discharged from the orifice is, e.g., 5 pl, and the discharge rate is about 15 mm/sec.

In FIG. 4, a discharged dot count value (cleaning execution threshold) for cleaning the orifice surface of the printhead by detecting the discharged dot count of each orifice group from 0 is set when the orifice groups of the three colors are arranged in an order of magenta (M), yellow (Y), and cyan (C) from the left, as shown in FIGS. 3A to 3C. FIG.

4 is a table showing the characteristic feature of the present invention. The first embodiment exemplifies wiping as a cleaning means, and the cleaning execution threshold will mean a wiping execution threshold. In-the first embodiment, the cumulative discharge count of a predetermined orifice group and a cleaning execution threshold corresponding to the orifice group are compared, and when the cumulative discharge count exceeds the cleaning execution threshold, cleaning is executed.

The first row of FIG. 4 represents the wiping execution threshold of the yellow central orifice group out of the three orifice groups. The cleaning execution threshold is 15,840,000 dots which correspond to the number of dots (discharge count) that print ½ of an image of 4,800×6,600 pixels per dot at 600 dpi×600 dpi. In the second row of FIG. 4, the wiping execution threshold of the two, magenta and cyan outer orifice groups (arranged on the two sides of the yellow central orifice group) out of the three orifice groups is 31,680,000 dots which correspond to the number of dots that print one image of 4,800×6,600 pixels per dot at 600 dpi×600 dpi. That is, the wiping execution threshold of an orifice group arranged between outermost orifice groups is set as low as ½ of the wiping execution threshold of the two outermost orifice groups in accordance with the position of the orifice group of each ink. In other words, the wiping execution threshold is set to a different value in accordance with the position of the orifice group of each ink.

In the printhead used in the first embodiment, orifice groups or orifice lines are aligned and formed in a direction different from a direction in which orifices are arrayed. The wiping execution threshold of an outer orifice group or orifice line formed in the direction in which the orifice groups or orifice lines are aligned, and the wiping execution threshold of an orifice group or orifice line formed inside from the outer orifice group or orifice line are set different. In the first embodiment, the direction (main scanning direction) in which the printhead reciprocates and the direction in which orifice groups or orifice lines are aligned are almost the same.

The first embodiment assumes a printhead in which each of magenta, yellow, and cyan orifice groups is formed by two orifice lines, as shown in FIG. 3B. As another printhead of the first embodiment, as shown in FIG. 3C, a printhead in which each of magenta, yellow, and cyan orifice groups is formed by one orifice line can also achieve the same effects as those described below. That is, the orifice group in the first embodiment includes one orifice line or two or more orifice lines for each ink.

In FIG. 3C, reference numeral 33 denotes a magenta (M) orifice line; 35, a yellow (Y) orifice line; and 37, a cyan (C) orifice line. One orifice line is formed for each color. The intervals between the magenta (M) and yellow (Y) orifice lines (groups) and the yellow (Y) and cyan (C) orifice lines (groups) each are a, and the interval between the magenta (M) and cyan (C) orifice lines (groups) is b.

Also in the printhead of FIG. 3C, as described with reference to FIG. 4, the wiping execution threshold of the yellow central orifice line out of the three orifice lines is 15,840,000 dots. The wiping execution threshold of the two, magenta and cyan outer orifice lines (arranged on the two sides of the yellow central orifice line) out of the three orifice lines is 31,680,000 dots.

FIG. 5 is a table showing comparison between the effect of uniformly setting the same wiping execution threshold for the orifice groups of the respective colors and the effect of setting the wiping execution thresholds in FIG. 4 according to the first embodiment when the printhead in FIG. 3B is used. FIG. 5 is a table showing image errors (printing distortion and printing omission) and the wiping count in correspondence with the wiping execution threshold.

Printed images were a total of 60 images: 10 images for each of A4-size solid images of magenta, cyan, and yellow primary colors (images each of 4,800×6,600 pixels per dot at 600 dpi×600 dpi), and 10 images for each of solid images of red (magenta and yellow), green (yellow and cyan), and blue (cyan and magenta) secondary colors (images each of 4,800×6,600 pixels per dot at 600 dpi×600 dpi). Whether a solid printing output result (printing medium) had printing distortion or printing omission was examined. Instead of examining whether a solid printing output result had printing distortion or printing omission, generation of an image error can also be examined by printing a predetermined pattern after outputting a solid printing image.

In the upper row of FIG. 5, the wiping execution thresholds of the orifice groups of the respective colors are uniformly set to 31,680,000 dots. In this case, the wiping count is 60 which is smaller than those in the middle and lower rows. However, image errors such as printing distortion and printing omission caused by non-discharge occur at very high frequency in printing of red (magenta and yellow) and green (yellow and cyan) in which an image is formed using adjacent orifice groups. Printing distortion occurs in eight images out of 10 images for red and eight images out of 10 images for green, i.e., a total of 16 images out of all the 60 printed images.

Printing omission occurs in five images out of 10 images for red and six images out of 10 images for green, i.e., a total of 11 images out of all the 60 printed images.

The upper row of FIG. 5 reveals that no printing distortion or printing omission occurs upon primary color solid printing in which no ink is discharged from adjacent orifice groups and secondary color solid printing of blue in which the distance between adjacent orifice groups is long, and printing distortion and printing omission occur upon secondary color solid printing of red and green in which the distance between adjacent orifice groups is short.

From the above results, printing distortion and printing omission occur for red and green because ink droplets discharged from adjacent orifice groups are influenced by air flows formed by adjacent flying ink droplets, compared to ink droplets discharged from a single orifice group, and a mist generated by ink droplets other than main droplets upon discharge or splash upon landing flies up under the influence of air flows and attaches to the face surface at a high possibility. For this reason, when the same wiping execution threshold of 31,680,000 dots is set for the orifice groups of the respective colors, image errors such as discharge distortion and non-discharge may occur in printing of a secondary color (e.g., red or green) or a tertiary color, compared to printing of a single color.

In the middle row of FIG. 5, the wiping execution thresholds of the orifice groups are uniformly set as half as 15,840,000 dots. In this case, no image error such as printing omission or printing distortion occurs in printing of red (magenta and yellow) and green (yellow and cyan) in which an image is formed using adjacent orifice groups. This is because, even if the wiping execution thresholds are uniformly set to the same value of 15,840,000 dots, the wiping execution timing is twice as fast as that at 31,680,000 dots in the upper row of FIG. 5, and wiping is executed before an image error is caused by deposition of an ink droplet or mist on the face surface under the influence of air flows generated upon discharging ink from adjacent orifice groups. Since, however, the wiping execution timing is twice as fast, the wiping count is 120 which is the largest in a case in which the same image is printed on the same number of printing media. Thus, the printhead wears soon by wiping, shortening the service life of the printhead.

To the contrary, the lower row of FIG. 5 exhibits the example described with reference to FIG. 4. The wiping execution threshold is set to a different value in accordance with the position of the orifice group of each color. For example, the wiping execution threshold of the yellow orifice group arranged between the cyan and magenta outermost orifice groups is set to 15,840,000 dots. The wiping execution threshold of the two, cyan and magenta outermost orifice groups is set to a different value of 31,680,000 dots. The wiping execution threshold is uniformly set to a high value of 31,680,000 dots for secondary colors such as red and green which use adjacent orifice groups. Compared to this, the discharged dot count exceeds the wiping execution threshold of 15,840,000 dots for the yellow central orifice group. Thus, the printhead is quickly wiped, preventing any image error such as printing distortion or non-discharge.

In printing of blue which is a secondary color formed by the two, magenta and cyan orifice groups arranged on the two sides of the yellow central orifice group, the wiping execution count is smaller than that in printing of another secondary color because the wiping execution threshold of magenta and cyan is higher than that of yellow. For this reason, no image error such as printing omission or printing distortion occurs, and the wiping count is also decreased to 90.

That is, it was confirmed that the printhead hardly wore by wiping to prolong the service life of the printhead in comparison with uniform setting of a low wiping execution threshold, and no image error such as printing omission or printing distortion occurred in comparison with uniform setting of a high wiping execution threshold.

In this manner, the wiping execution threshold is changed in accordance with the position of the orifice group of each color. For example, the wiping execution threshold of an orifice group arranged between outermost orifice groups and the wiping execution threshold of the two outermost orifice groups are set to different values. This can prevent attachment of ink on the face surface under the influence of air flows generated by ink discharge upon simultaneous discharge from adjacent orifice groups. Also, the wiping execution count does not unnecessarily increase, and a high-durability inkjet printer which outputs a stable image can be provided.

The first embodiment employs the wiping means as a means of cleaning the orifice surface of the printhead, but another means such as suction can also be applied.

In the first embodiment, when the cleaning condition of a predetermined orifice group out of a plurality of orifice groups has been established, not only the predetermined orifice group but also all the orifice groups, i.e., the orifice surface of the printhead, is cleaned. In a printing apparatus capable of cleaning each of the orifice groups, only an orifice group which satisfies the cleaning condition may be cleaned. In the arrangement in which not only a predetermined orifice group but also all the orifice groups are simultaneously cleaned, when the cleaning condition of the predetermined orifice group has been established and cleaning is done, not only the cumulative discharge count of the predetermined orifice group but also the cumulative discharge counts of the cleaned orifice groups are cleared to a default value.

The discharge counting method in the first embodiment is a count-up method from 0, but may be a count-down method from a predetermined value. In the count-down method, the wiping execution threshold of a central orifice group must be set lower than the wiping execution threshold of two orifice groups arranged on the two sides of the central orifice group. This is because the wiping execution threshold must be set such that when the actual ink discharge count of the central orifice group and the actual ink discharge counts of the two outermost orifice groups exhibit the same value, the central orifice group is wiped prior to the orifice groups on the two sides of the central orifice group.

Figure 6B:
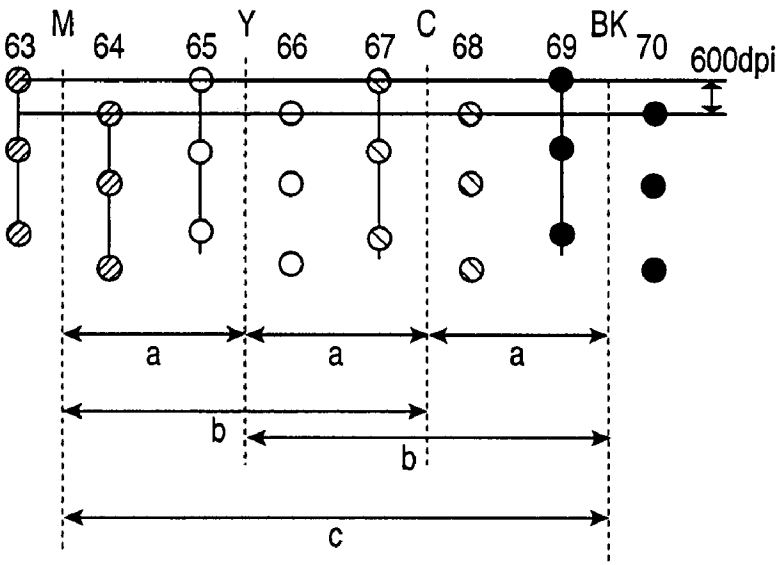
FIG. 6B is an enlarged view of a portion X surrounded by a dotted line in FIG. 6A.
Figure 6A:
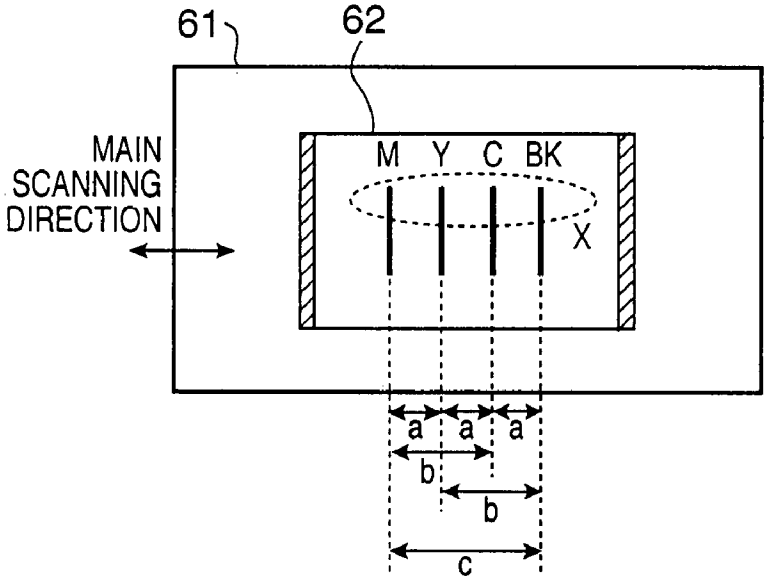
FIG. 6A is a schematic view showing a printhead having four orifice groups for discharging inks of four colors (C, M, Y, and Bk) when viewed from the discharge direction.

Setting of the wiping execution threshold in a printhead in which four orifice groups are aligned, as shown in FIGS. 6A and 6B, as another printhead of the first embodiment will be explained.

FIG. 6A is a schematic view showing a printhead having four orifice groups for discharging inks of four colors (C, M, Y, and Bk) when viewed from the discharge direction.

Reference numeral 61 denotes a TAB portion where wiring lines are formed; and 62, a chip portion where orifices are formed. Orifice groups are formed at equal intervals corresponding to a width a in an order of magenta, yellow, cyan, and black from the left. FIG. 6B is an enlarged view showing a portion X surrounded by a dotted line in FIG. 6A. Reference numerals 63 and 64 denote magenta orifice lines. These two orifice lines form a magenta orifice group. Similarly, reference numerals 65 and 66 denote yellow orifice lines; 67 and 68, cyan orifice lines; and 69 and 70, black orifice lines. The two orifices form an orifice group of each color.

The intervals between the magenta and yellow orifice groups, the yellow and cyan orifice groups, and the cyan and black orifice groups each are a, the intervals between the magenta and cyan orifice groups and the yellow and black orifice groups each are b, and the interval between the magenta and black orifice groups is c. In the printhead, for example, the width a is 1.5 mm, the width b is 3.0 mm, and the width c is 4.5 mm.

The interval between orifices in the orifice line direction is 600 dpi, and the two orifice lines are alternately arranged. The discharge amount of an ink droplet discharged from the orifice is, e.g., 5 pl, and the discharge rate is about 15 mm/sec.

In FIG. 7, a discharged dot count value (wiping execution threshold) for wiping the orifice surface of the printhead by detecting the discharged dot count of each orifice group from 0 is set when the orifice groups of the four colors are arranged in an order of magenta, yellow, cyan, and black from the left, as shown in FIGS. 6A and 6B.

In the first row of FIG. 7, the wiping execution threshold of the yellow and cyan central orifice groups out of the four orifice groups is 15,840,000 dots which correspond to the number of dots that print ½ of an image of 4,800×6,600 pixels per dot at 600 dpi×600 dpi. In the second row of FIG. 7, the wiping execution threshold of the two, magenta and black outermost orifice groups out of the four orifice groups is 31,680,000 dots which correspond to the number of dots that print one image of 4,800×6,600 pixels per dot at 600 dpi×600 dpi. That is, the wiping execution threshold of orifice groups arranged between outermost orifice groups is set as low as ½ of the wiping execution threshold of the two outermost orifice groups in accordance with the position of the orifice group of each ink. In other words, the wiping execution threshold is set to a different value in accordance with the position of the orifice group of each ink.

Also in the printhead having the four orifice groups, the wiping execution threshold is set to a different value in accordance with the position of the orifice group of each color. For example, the wiping execution threshold of an orifice group arranged between outermost orifice groups and-the wiping execution threshold of the two outermost orifice groups are set to different values. This can prevent attachment of ink on the face surface under the influence of air flows generated by ink discharge upon simultaneous discharge from adjacent orifice groups. Also, the wiping execution count does not unnecessarily increase, and a high-durability inkjet printer which outputs a stable image can be provided.

A printhead having five or more orifice groups can also attain the same effects as those described in the first embodiment by setting the wiping execution threshold of a central orifice group and the wiping execution threshold of two outermost orifice groups to different values in accordance with the position of the orifice group of each ink.

In the first embodiment, the cumulative discharge count of one orifice group formed by two orifice lines is calculated in the use of a printhead having two orifice lines for one color, as shown in FIG. 3B. When the distance between the orifice lines is shorter than that in FIG. 3B, the influence of air flows generated upon discharging ink from adjacent orifice lines such as the orifice lines 33 and 34 may not be ignored. At this time, the cumulative discharge count may be detected for each orifice line, and the wiping execution threshold may be set to different values for the outermost orifice lines (33 and 38) and orifice lines (34 to 37) arranged between the outermost orifice lines.

As described above, according to the first embodiment, the cleaning execution threshold of a central orifice group and the cleaning execution threshold of two orifice groups arranged on the two sides of the central orifice group are set to different values in accordance with the position of the orifice group of each color ink. The first embodiment can provide an inkjet printer which can reduce image errors and the wear of the printhead.

In the first embodiment, the printhead of the printing apparatus cannot be exchanged, and thus the cleaning execution threshold is set to a predetermined value for an orifice group. When the present invention is practiced in a printing apparatus in which a plurality of printheads having different orifice arrangements can be exchanged, a detection means capable of detecting the distance between orifice groups or orifice lines may be arranged, and the cleaning execution threshold may be changed in accordance with the distance between orifice groups or orifice lines. At this time, when the distance between orifice groups or orifice lines is larger than a predetermined distance, the cleaning execution thresholds of all the orifice groups or orifice lines may be set to a predetermined value. When the distance between orifice groups or orifice lines is equal to or smaller than the predetermined distance, the cleaning execution threshold of outer orifice groups or orifice lines and that of middle orifice groups or orifice lines may be set to different values.

Image errors and the wear of the printhead can be reduced by setting the cleaning execution threshold in accordance with whether the distance between orifice groups or orifice lines is short.

As a method of detecting the distance between orifice groups or orifice lines, a predetermined pattern may be printed on a printing medium and read by a photosensor to detect the distance between orifice groups or orifice lines. As another method, the printhead may be equipped with a memory which stores information on the distance between orifice groups or orifice lines, and the printing apparatus may read out the information on the distance between orifice groups or orifice lines that is stored in the memory of the mounted printhead, thereby detecting the distance between orifice groups or orifice lines.

In the first embodiment, whether the cleaning execution condition for executing cleaning operation has been established is determined by comparing the discharge count of a predetermined orifice group or orifice line and the cleaning execution threshold. Alternatively, the discharge amount of an orifice group or orifice line and the cleaning execution threshold may be compared. By using the discharge amount of an orifice group or orifice line, even a printhead capable of discharging ink by different discharge amounts from the same printhead can be cleaned at a proper timing, reducing image errors.

Second Embodiment

The second embodiment of the inkjet printing apparatus described in the first embodiment will be explained using a printhead in FIG. 3B. FIG. 3B shows a printhead having three orifice groups for discharging inks of three colors (C, M, and Y).

In an inkjet printer in which the printhead according to the second embodiment is mounted, no cleaning execution threshold is changed in accordance with the position of the orifice group. Instead, a predetermined cleaning execution threshold is used, and arithmetic processing of weighting the discharged dot count of each orifice group is performed in accordance with the position of the orifice group (to be described later) in calculating the cumulative discharge count of the orifice group. This weighting coefficient is changed.

In FIG. 8, the value of counter value integrating processing for the discharged dot count of each orifice group is set when three orifice groups are arranged in an order of magenta, yellow, and cyan from the left. In this case, the wiping execution threshold is uniformly set to a predetermined value of 31,680,000 dots regardless of the position of the orifice group. In the first row of FIG. 8, the weighting/integrating processing value of a discharged dot count Din of the yellow central orifice group out of the three orifice groups is Din×2 which corresponds to the number of dots that print ½ of an image of 4,800×6,600 pixels per dot at 600 dpi×600 dpi.

In the second row of FIG. 8, the weighting/integrating processing value of a discharged dot count Dout of the two, magenta and cyan orifice groups arranged on the two sides of the central orifice group out of the three orifice groups is Dout×1 which corresponds to the number of dots that print one image of 4,800×6,600 pixels per dot at 600 dpi×600 dpi.

Din represents the discharged dot count of a central orifice group out of orifice groups, and Dout represents the discharged dot count of two outermost orifice groups (arranged on the two sides of the central orifice group). That is, the weighting processing value (weighting coefficient) for the discharged dot count of the central orifice group is set twice as large as the weighting processing value (value obtained by multiplying a discharged dot count by a weighting coefficient) for the discharged dot count of the two outermost orifice groups (arranged on the two sides of the central orifice group) in accordance with the position of the orifice group of each ink.

Weighting processing in the second embodiment is integrating processing, but may be another arithmetic processing.

FIG. 9 is a table showing comparison between the effect of uniformly setting the same weighting coefficient for the discharged dot counts of the orifice groups of the respective colors and the effect of setting the weighting processing value for the discharged dot count of a central orifice group in FIG. 8 and the weighting processing value for the discharged dot counts of two outermost orifice groups (arranged on the two sides of the central orifice group) to different values according to the second embodiment when the printhead having the arrangement in FIG. 3B is used. FIG. 9 shows image errors and the wiping count in correspondence with the weighting value for the discharged dot count of each orifice group.

Printed images were a total of 60 images: 10 images for each of A4-size solid images of magenta, cyan, and yellow primary colors (images each of 4,800×6,600 pixels per dot at 600 dpi×600 dpi), and 10 images for each of solid images of red (magenta and yellow), green (yellow and cyan), and blue (cyan and magenta) secondary colors (images each of 4,800×6,600 pixels per dot at 600 dpi×600 dpi). Whether a solid printing output result had any image error was examined.

In the upper row of FIG. 9, the weighting/integrating processing values for the discharged dot counts of the orifice groups of the respective colors are uniformly set to the discharged dot count×1. In this case, the wiping count is 60 which is the smallest. However, image errors such as printing distortion and printing omission caused by non-discharge occur at very high frequency in printing of red (magenta and yellow) and green (yellow and cyan) in which an image is formed using adjacent orifice groups. Printing distortion occurs in eight images out of 10 images for red and eight images out of 10 images for green, i.e., a total of 16 images out of all the 60 printed images. Printing omission occurs in five images out of 10 images for red and six images out of 10 images for green, i.e., a total of 11 images out of all the 60 printed images.

In the middle row of FIG. 9, the weighting/integrating process values for the discharged dot counts of the orifice groups of the respective colors are uniformly set to the discharged dot count×2. In this case, no image error such as printing omission or printing distortion occurs in printing of red (magenta and yellow) and green (yellow and cyan) in which an image is formed using adjacent orifice groups. This is because the weighting/integrating processing value for the discharged dot count of the orifice group of each color is twice as large as that in the upper row, the counter value of the discharged dot count becomes large twice as fast as that in the upper row of FIG. 9, the discharged dot count of each orifice group reaches the same wiping execution threshold twice as fast, and wiping is executed before an image error is caused by deposition of an ink droplet or mist on the face surface under the influence of air flows generated upon discharging ink from adjacent orifice groups. Since, however, the wiping execution timing is twice as fast, the wiping count is 120 which is the largest in a case in which the same image is printed on the same number of printing media. Thus, the printhead wears soon by wiping, shortening the service life of the printhead.

To the contrary, the lower row of FIG. 9 exhibits the example described with reference to FIG. 8. For example, the weighting processing value (weighting coefficient×2) of the yellow orifice group arranged between the cyan and magenta outermost orifice groups is set to Din×2. The weighting processing value (weighting coefficient×1) of the two, cyan and magenta outermost orifice groups is set to Din×1. The weighting coefficient is uniformly set to ×1 for secondary colors such as red and green which use adjacent orifice groups. Compared to this, the weighting coefficient of the yellow central orifice group is set to ×2. Thus, the printhead is quickly wiped, preventing any image error such as printing distortion or non-discharge.

In printing of blue which is a secondary color formed by the two, magenta and cyan outermost orifice groups, the wiping execution count is smaller than that in printing of another secondary color because the weighting coefficient for magenta and cyan discharged dot counts is set to ×1. Hence, no image error such as printing omission or printing distortion occurs, and the wiping count is also decreased to 90.

That is, it was confirmed that the printhead hardly wore by wiping to prolong the service life of the printhead in comparison with uniform setting of the weighting coefficient for the discharged dot counts of the orifice groups, and no image error such as printing omission or printing distortion occurred in comparison with uniform setting of a weighting coefficient of ×1.

In this fashion, the weighting processing value (weighting coefficient) for the discharged dot count is changed in accordance with the position of the orifice group of each color. For example, the weighting processing value (weighting coefficient) of an orifice group arranged between outermost orifice groups and the weighting processing value (weighting coefficient) of the two outermost orifice groups are set to different values. This can prevent any image error caused by attachment of ink on the face surface under the influence of air flows generated by ink discharge upon simultaneous discharge from adjacent orifice groups. The wiping execution count does not unnecessarily increase, and a high-durability inkjet printer which outputs a stable image can be provided.

Also in the second embodiment, the weighting processing value (weighting coefficient) for the discharged dot count of a central orifice group and the weighting processing value for the discharged dot count of two orifice groups arranged on the two sides of the central orifice group are set to different values in accordance with the position of the orifice group of each color ink. The second embodiment can provide an inkjet printer almost free from any image error and the wear of the printhead.

In the second embodiment, the discharged dot count of ink droplets discharged from the orifice group of each color ink is detected. In discharging ink from the central orifice group, image errors such as landing distortion and non-discharge may be generated by a mist of ink droplets discharged from an outer orifice group of the printhead due to a small interval between orifice groups of the respective color inks. In this case, a value obtained by adding the discharged dot count of ink droplets discharged from a predetermined orifice group and the discharged dot count of ink droplets discharged from orifice groups arranged on the two sides of the predetermined orifice group may be defined as the discharged dot count of the predetermined orifice group. More specifically, the weighting coefficient is set to ×1 for the discharged dot count of ink droplets discharged from the predetermined orifice group, and ×0.3 for the discharged dot count of ink droplets discharged from the orifice groups arranged on the two sides of the predetermined orifice group. The sum of these weighting coefficients is defined as the discharged dot count of ink droplets discharged from the predetermined orifice group.

Third Embodiment

In the first and second embodiments, the cleaning execution threshold is set for each orifice group or orifice line. Whether to clean the printhead is determined by comparing the cumulative discharge count of each counted orifice group or orifice line and the cleaning execution threshold. Alternatively, weighting can be performed in accordance with the arrangement position of the orifice group or orifice line of the printhead, and the cumulative discharge count of all the orifices of the printhead and a cleaning execution threshold corresponding to the printhead can be compared to determine the cleaning execution timing of the printhead.

In the third embodiment, a cleaning execution threshold for the printhead is set in place of setting a cleaning execution threshold for each orifice group or orifice line. The cumulative discharge count of all the orifices is detected, and the cleaning execution threshold and cumulative discharge count are compared to determine the cleaning execution timing. In detecting the cumulative discharge count of all the orifices, weighting corresponding to the arrangement position of the orifice group or orifice line is executed to detect the cumulative discharge count of the orifice groups or orifice lines, similar to the second embodiment.

As described above, the third embodiment also performs weighting corresponding to the arrangement position of the orifice group or orifice line to detect the cumulative discharge count. Cleaning can be executed at a timing when image errors can be reduced.

Other Embodiment

The present invention may be applied to a system including a plurality of devices (e.g., a host computer, interface device, reader, and printer) or an apparatus (e.g., a copying machine or facsimile apparatus) formed from a single device.

The object of the present invention is also achieved when a storage medium (or recording medium) which stores software program codes for realizing the functions of the above-described embodiments is supplied to a system or apparatus, and the computer (or the CPU or MPU) of the system or apparatus reads out and executes the program codes stored in the storage medium.

When the present invention is applied to the storage medium, the storage medium stores the cleaning execution threshold in FIG. 5, a cleaning control program in printing that contains weighting processing for the discharged dot count shown in FIG. 9, and various tables. These programs codes can also be provided as updatable firmware.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus having a printhead with an orifice surface including a plurality of orifice groups each having a plurality of orifices for discharging ink, comprising:

cleaning means for cleaning the orifice surface; and cleaning control means for causing said cleaning means to execute a cleaning operation in accordance with ink discharge counts of the plurality of orifice groups, wherein respective ink discharge counts, corresponding to respective orifice groups at both ends of the plurality of orifice groups, required to execute the cleaning operation are greater than an ink discharge count, corresponding to another orifice group different from the orifice groups at both ends, required to execute the cleaning operation.

2. The apparatus according to claim 1, wherein said cleaning control means determines, on the basis of the respective ink discharge counts of the plurality of orifice groups, whether a predetermined cleaning condition which changes in accordance with a formation position of the orifice group has been established, and when the predetermined cleaning condition has been established, causes said cleaning means to execute the cleaning operation.

3. The apparatus according to claim 2, wherein said cleaning control means determines as the predetermined cleaning condition whether the respective discharge counts of the plurality of orifice groups has reached a predetermined count.

4. The apparatus according to claim 2, wherein said cleaning control means determines as the cleaning condition whether a value obtained by multiplying the respective discharge counts of the plurality of orifice groups by a weighting coefficient has reached a predetermined count, and a weighting coefficient corresponding to the respective orifice groups at both ends and a weighting coefficient corresponding to the other group different from the orifice groups at both ends are different.

5. The apparatus according to claim 4, wherein the weighting coefficient corresponding to the respective orifice groups at both ends is smaller than the weighting coefficient corresponding to the other orifice group different from the orifice groups at both ends.

6. The apparatus according to claim 2, wherein said cleaning control means determines as the cleaning condition whether a value obtained by multiplying the respective discharge counts of the plurality of orifice groups by a weighting coefficient has reached a predetermined count, and a weighting coefficient corresponding to a predetermined orifice group and a weighting coefficient corresponding to another orifice group formed outside the predetermined orifice group are different.

7. The apparatus according to claim 2, further comprising:

detection means for detecting a distance between the orifice groups formed in the printhead; and setting means for setting the predetermined cleaning condition in accordance with the distance between the orifice groups that is detected by said detection means.

8. The apparatus according to claim 2, wherein when said cleaning control means determines that the predetermined cleaning condition for any one of the plurality of orifice groups has been established, said cleaning control means causes said cleaning means to execute the cleaning operation.

9. The apparatus according to claim 1, wherein said cleaning control means defines, as an ink discharge count discharged from the printhead, a value obtained by multiplying the respective ink discharge counts of the plurality of orifice groups by a weighting coefficient corresponding to a formation position of the orifice group, determines whether a cleaning condition of the printhead has been established, on the basis of the ink discharge count discharged from the printhead, and when the cleaning condition of the printhead has been established, causes said cleaning means to execute the cleaning operation.

10. The apparatus according to claim 9, wherein a weighting coefficient corresponding to a predetermined orifice group and a weighting coefficient corresponding to another orifice group formed outside the predetermined orifice group are different.

11. The apparatus according to claim 9, further comprising detection means for detecting a distance between the orifice groups formed in the printhead, wherein the weighting coefficient is changed in accordance with the distance between the orifice groups that is detected by said detection means.

12. The apparatus according to claim 1, wherein said cleaning means comprises wiping means for wiping a face of the orifice surface by an elastic member.

13. The apparatus according to claim 1, wherein the orifice groups are arranged for at least yellow, magenta, and cyan colors.

14. A cleaning control method for an inkjet printing apparatus having a printhead with an orifice surface including a plurality of orifice groups each having a plurality of orifices for discharging ink, comprising:

cleaning step of cleaning the orifice surface; and a cleaning control step of causing said cleaning step to execute a cleaning operation in accordance with ink discharge counts of the plurality of orifice groups, wherein respective ink discharge counts, corresponding to respective orifice groups at both ends of the plurality of orifice groups, required to execute the cleaning operation are greater than an ink discharge count, corresponding to another orifice group different from the orifice groups at both ends, required to execute the cleaning operation.

15. The method according to claim 14, wherein in said cleaning control step, a value obtained by multiplying the respective discharge counts of the plurality of orifice groups by a weighting coefficient corresponding to a formation position of the orifice group is defined as an ink discharge count discharged from the printhead, whether a cleaning condition of the printhead has been established is determined on the basis of the ink discharge count discharged from the printhead, and when the cleaning condition of the printhead has been established, the cleaning operation is executed.

16. The method according to claim 14, wherein in said cleaning control step, when the respective ink discharge counts of the plurality of orifice groups reaches a predetermined value, a cleaning condition is determined to have been established and the cleaning operation is executed, and a predetermined count corresponding to the respective orifice groups at both ends and a predetermined count corresponding to the other group different from the orifice groups at both ends are different.

17. The method according to claim 14, wherein in said cleaning control step, when a value obtained by multiplying the respective ink discharge counts of the plurality of orifice groups by a weighting coefficient reaches a predetermined value, a cleaning condition is determined to have been established and the cleaning operation is executed, and a weighting coefficient corresponding to the respective orifice groups at both ends and a weighting coefficient corresponding to the other group different from the orifice groups at both ends are different.

18. An inkjet printing apparatus having a printhead with an orifice surface including a plurality of orifice groups each having a plurality of orifices for discharging ink, and cleaning means for cleaning the orifice surface, comprising:

storage means for storing, for each of the plurality of orifice groups, information regarding an ink discharge amount discharged from the orifice group; and cleaning control means for causing the cleaning means to execute a cleaning operation when the ink discharge amount corresponding to the information stored in said storage means reaches a predetermined amount, wherein respective ink discharge amounts, corresponding to respective orifice groups at both ends of the plurality of orifice groups, required to execute the cleaning operation are greater than an ink discharge amount, corresponding to another orifice group different from the orifice groups at both ends, required to execute to the cleaning operation.

* * * * *

UNITED STATES PATENT AND TRADEMARK OFFICE

CERTIFICATE OF CORRECTION

PATENT NO. : 7,118,190 B2
APPLICATION NO. : 10/781737
DATED : October 10, 2006
INVENTOR(S) : Sakamoto et al.

It is certified that error appears in the above-identified patent and that said Letters Patent is hereby corrected as shown below:

COLUMN 9:
Line 4, “In-the” should read --In the--.

COLUMN 13:
Line 2, “and-the” should read --and the--.

COLUMN 19:
Line 17, “cleaning step” should read --a cleaning step--.

Signed and Sealed this

Eighth Day of July, 2008

JON W. DUDAS
*Director of the United States Patent and Trademark Office*